US005649677A

United States Patent [19]

Culp

[11] Patent Number: 5,649,677

[45] Date of Patent: Jul. 22, 1997

[54] COLLAPSIBLE SPOOL

[76] Inventor: Barney L. Culp, Rte. 2, Box 59, Chester, S.C. 29706

[21] Appl. No.: 611,499

[22] Filed: Mar. 6, 1996

Related U.S. Application Data

[63] Continuation of Ser. No. 309,075, Sep. 20, 1994, abandoned.

[51] Int. Cl.[6] ..... B65H 75/24; B65H 75/22

[52] U.S. Cl. ..... 242/607.1; 242/407.1

[58] Field of Search ..... 242/607.1, 407.1

[56] References Cited

U.S. PATENT DOCUMENTS

| | | | |
|---|---|---|---|
| 1,559,133 | 10/1925 | Tunis et al. . | |
| 1,742,584 | 1/1930 | Daubmeyer et al. . | |
| 2,010,811 | 8/1935 | Craig . | |
| 2,463,192 | 3/1949 | Mackey et al. . | |
| 3,661,341 | 5/1972 | Eifrid . | |
| 3,791,606 | 2/1974 | Brown . | |
| 4,198,012 | 4/1980 | Esmonde et al. | 242/607.1 |
| 5,169,086 | 12/1992 | Vesely | 242/607.1 |

FOREIGN PATENT DOCUMENTS

| | | | |
|---|---|---|---|
| 3536555 | 4/1987 | Germany | 242/607.1 |
| 467787 | 6/1937 | United Kingdom | 242/407.1 |

*Primary Examiner*—John Q. Nguyen
*Attorney, Agent, or Firm*—Dority & Manning, P.A.

[57] ABSTRACT

A collapsible spool for storing, winding, unwinding and transporting cable products and the like is provided. The collapsible spool includes a pair of opposing side panels having a plurality of foldable arms extending therebetween. The foldable arms include a first segment and a second segment pivotally joined at adjacent ends for allowing the arms to fold radially outward for collapsing the spool. Each arm is hingedly connected at each end to the opposing side panels. In particular, each arm can include an inner hinge arrangement located at one end and an outer hinge arrangement located at an opposite end. The inner hinge and outer hinge prevent the arms from folding radially inward. Further, the inner hinge and outer hinge fold together when the spool is collapsed.

18 Claims, 7 Drawing Sheets

COLLAPSIBLE SPOOL

This is a continuation of application Ser. No. 08/309,075, filed Sep. 20, 1994, which was abandoned upon the filing hereof.

BACKGROUND OF THE INVENTION

The present invention generally relates to reusable spools and more particularly to collapsible spools for winding, storing, and unwinding cable, rope, wire, line and the like.

Generally, cable products such as electrical wire, telephone lines, television cable, rope, optical fibers, tubing, etc. are stored, transported and used on large wooden or plastic spools. Once empty, the spools must be disposed of or returned for reuse. Currently, disposal is not considered an environmentally viable option in view of the wood or other materials that are needed to make the spools. Further, the manufacture of these spools can be costly and consequently, their disposal is not economically advantageous.

On the other hand, the transportation of these spools for reuse presents other problems. For instance, cable spools take up a considerable amount of space which imposes a limitation on the number of spools which can be loaded on a truck or rail car. As such, the transportation of empty cable spools can represent a significant cost. Ultimately, these costs are added to the costs of the cable product.

These disadvantages have been recognized in the past prompting many attempts to create a spool or reel that is reusable and which disassembles or can be reduced in size when empty. For instance, in U.S. Pat. No. 3,791,606 to Brown, a collapsible cable spool is disclosed. The spool includes radially fluted flanges and a plurality of foldable drum or core sectors pivotally carried in the flutes to permit the spools to be collapsed for storage and shipment. The foldable drum or core sectors include a pair of equal length bar like segments which are pivotally connected at one end and have their opposed end pivotally mounted within the flute. As a means to limit the pivotal movement of the segments, each inner end of the segment has a notch which abuts against a clip to act as a stop or lock to act against further pivoting in the direction of the open position.

In U.S. Pat. No. 1,742,584 to Daubmeyer, et al., a collapsible metallic reel is described having two circular side members attached together by a plurality of sections. Each section consists of two parts hingedly united and also hingedly connected to the two side plates. The sections can further include a tongue on one or each of the parts which will engage the respected companion part when the section is fully extended to prevent a bending of the joint inwardly past the horizontal.

A folding reel is disclosed in U.S. Pat. No. 1,559,133 to Tunis, et al. The folding reel in Tunis, et al. includes two counterpart heads with a four part shank therebetween. The four part shank includes four slats supported by hinges on plates secured to the heads. The hinges are arranged such that the heads may be folded in one direction only. In order to lock the device in an erect position a brace or arm extends diagonally between the heads.

Other similar reel devices are disclosed in U.S. Pat. No. 3,661,341 to Eifrid, U.S. Pat. No. 2,463,192 to Mackey, et al., and U.S. Pat. No. 2,010,811 to Craig.

Although the prior art discloses various attempts to make a reusable reel or spool that can be disassembled or reduced in size for storage and transportation, the prior art still has many deficiencies and draw backs. For instance, many of the collapsible spools are too complicated and too expensive to manufacture. Other spools or reels have not proven to be strong enough to withstand the loads of many cable products when reeled onto the device. Still other prior art constructions remain bulky and difficult to handle even when collapsed or disassembled.

SUMMARY OF THE INVENTION

The present invention recognizes and addresses the foregoing disadvantages, and others of prior art construction and methods.

Accordingly, it is an object of the present invention to provide an improved collapsible spool.

It is another object of the present invention to provide a collapsible spool for storing, transporting, winding and unwinding cable products.

Another object of the present invention is to provide a spool having arms that collapse onto each other.

It is a further object of the present invention to provide a collapsible spool that can be reused and that can be easily and economically transported when empty.

These and other objects of the present invention are achieved by providing a collapsible spool for storing, winding, unwinding and transporting cable products and the like. The collapsible spool includes a pair of opposing side panels. Each of the side panels has a flange portion and a circular center portion. A plurality of foldable arms are hingedly connected to the opposing side panels at opposite ends. The arms are spaced circumferentially around the corresponding center portions for forming a spool core. In particular, the foldable arms include a first segment and a second segment which are pivotally joined at adjacent ends for allowing the arms to fold radially outward for collapsing the spool.

The foldable arms are connected to the side panels of the spool by a first hinge located at a first end of the arms and a second hinge located at the opposite end of the arms. The first and second hinges include at least one hinge plate attached to the arms which limit the movement of the segments of the arms from folding radially inward past a substantially horizontal and open position. In one embodiment, the first hinge can include an inner hinge plate centrally mounted to the first end of the arm while the second hinge can include a pair of outer hinge plates located at the lateral edges of the second end of the arms. In this arrangement, when the spool is collapsed, the first hinge and the second hinge fold together.

The first hinge can further include a vertical hinge member protruding from the opposing side panels. The hinge plates of the first hinge can then be pivotally connected to the hinge member. Similarly, the second hinge can include L-shaped members mounted to the opposing side panels. The L-shaped members can be pivotally connected to the hinge plates integral with the second hinge.

The collapsible spool as described above can also include support disks mounted to the circular center portions of each side panel. The support disks can be provided for connecting to and supporting the foldable arms.

When the above described spool is placed in an open position, the first hinge and the second hinge can be adjusted so that the arms remain angled a few degrees radially outward for preventing the arms from folding radially inward when supporting a load. For further preventing the arms from collapsing inward, the pivot point between the adjoining segments of the arms can be spaced radially above the pivot points of the first hinge and the second hinge.

In one embodiment, the collapsible spool of the present invention can include from about 3 to about 20 foldable arms. In particular, the arms can be spaced about ¼ of an inch apart circumferentially around the center portion of the opposing side panels when forming the spool core.

These and other objects of the present invention are also achieve by providing a collapsible spool including a pair of opposing circular side panels. A plurality of foldable arms are hingedly connected to the opposing side panels at opposite ends for forming a spool core. The foldable arms include a first segment and a second segment being pivotally joined at adjacent ends. An inner hinge is provided for connecting a first end of the arms to the side panel. The inner hinge includes at least one inner hinge plate centrally mounted to the first end of the arms and pivotally connected to the side panel. The inner hinge plate prevents the first end of the arms from folding radially inward past a substantially horizontal position.

An outer hinge is also provided for connecting a second and opposite end of the arms to the side panels. The outer hinge includes a pair of outer hinge plates laterally spaced at the second end of the arms and pivotally connected to the side panels. The outer hinge plates prevent the second end of the arms from folding radially inward past a substantially horizontal position. The inner hinge and outer hinge of each arm are arranged such that when the spool is collapsed, the inner hinge folds into the outer hinge for providing a close fit therebetween.

In alternative embodiments, the foldable arms can be spaced circumferentially around a circular inner portion of the side panels such that the inner hinges and outer hinges connected to the arms alternate around each of the panels. Further, the foldable arms can be made from a light weight structural metal while the side panels can also include a support disk mounted thereto for connecting to and supporting the foldable arms.

In order to provide strength to the spool the pivot point between the adjoining segments of the arms can be spaced radially above the pivot points of the inner hinge and the outer hinge. Also, the spool can be arranged such that when the spool is open, the segments of the arms remain angled a few degrees radially outward for preventing the arms from folding radially inward.

Other objects, features and aspects of the present invention are discussed in greater detail below.

BRIEF DESCRIPTION OF THE DRAWINGS

A full and enabling disclosure of the present invention, including the best mode thereof, to one of ordinary skill in the art, is set forth more particularly in the remainder of the specification, including reference to the accompanying figures, in which.

Figure 1:
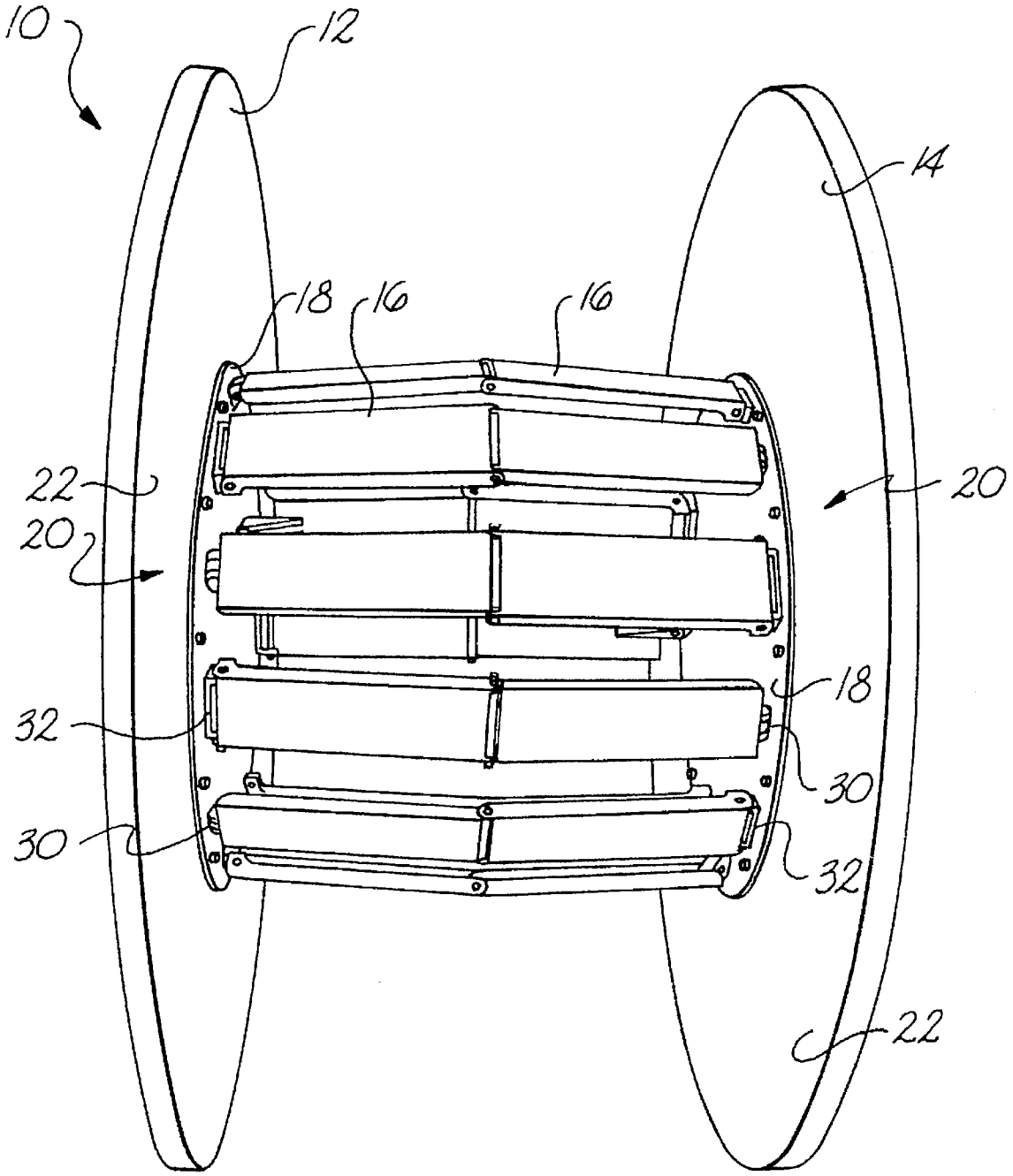
FIG. 1 is a perspective view of one embodiment of a collapsible spool in accordance with the present invention.

Repeat use of reference characters in the present specification and drawings is intended to represent same or analogous features of the invention.

DETAILED DESCRIPTION OF PREFERRED EMBODIMENTS

It is to be understood by one of ordinary skill in the art that the present specification is a description of exemplary embodiments only, and is not intended as limiting the broader aspects of the present invention, which broader aspects are embodied in the exemplary construction.

The present invention generally relates to a collapsible spool for holding cable products. As used herein, cable products refer to rope, wire, fibers, such as optical fibers, electrical wires, television cable, phone lines, flexible tubing, hoses, and the like. The present invention can be used to store, wind, and unwind these types of products. Further, when empty, the collapsible spool of the present invention is completely collapsible for facilitating the handling and transportation of the spool.

Referring to FIG. 1, one embodiment of a collapsible spool made in accordance with the present invention is illustrated generally at 10. Spool 10 includes a pair of opposing side panels or plates 12 and 14 which are connected together by a plurality of foldable arms 16. Attached to each panel is a support disk 18 which generally defines a circular center portion 20. Arms 16 are circumferentially spaced around center portion 20 to form a spool core for holding cable products. Specifically, the ends of arms 16 are connected to support disk 18.

Panels or plates 12 and 14 include a flange portion 22 which extends from center portion 20. Flange portion 22 acts as a support wall for holding and protecting the cable products. As shown in FIG. 1, panels 12 and 14 are generally circular in shape. However, the opposing panels can be one of a variety of shapes including squares, rectangles or ovals depending upon how the spool is to be used and the particular product that is to be wound on the core.

Spool 10 can be made from a variety of materials. In particular, panels 12 and 14 can be made from wood or plastics, and preferably from recycled materials such as recycled polymers. Arms 16 should be made from a structural material that will be capable of supporting a product that is to be wound around the core. In most applications, arms 16 will be made from a light weight metal or alloy such as aluminum for providing strength without adding excessive weight to the spool. However, in other applications, where strength requirements are not as high, arms 16 can be made from a structural plastic or from wood. Support disk 18 which is used to support arms 16 on plates 12 and 14 is preferably made from a metal. However, if plates 12 and 14 were made from a hard material, it may not be necessary to include support disks 18.

Figure 2:
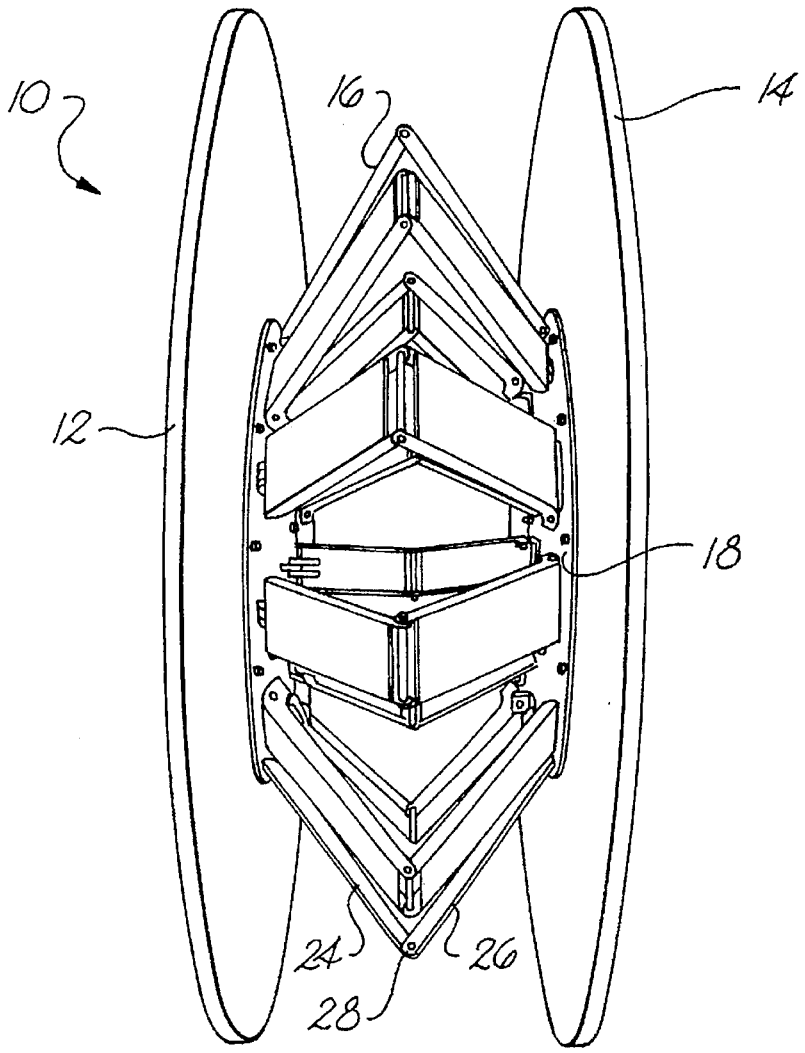
FIG. 2 is a perspective view of the embodiment illustrated in FIG. 1 in a partially collapsed state.

Referring to FIG. 2, spool 10 is shown in a partially collapsed state. In order to collapse spool 10, arms 16 are folded in a radially outward direction. In order to fold outward, arms 16 are constructed of a first segment 24 and a second segment 26. Segments 24 and 26 are pivotally joined at adjacent ends by a pin 28. Further, the ends of arms 16 are hingedly connected to support disks 18 which will be described in more detail hereinafter.

Figure 3:
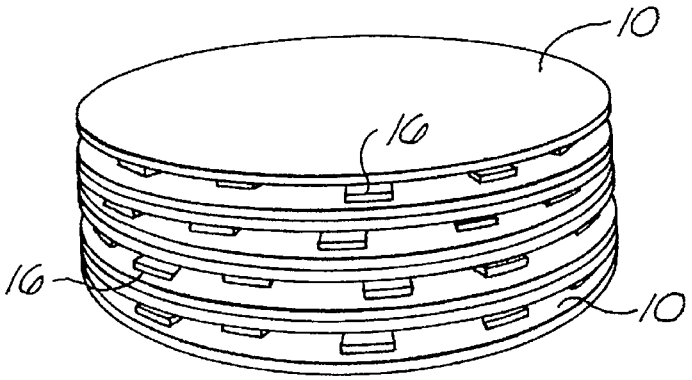
FIG. 3 is a perspective view of the embodiment illustrated in FIG. 1 in a totally collapsed state.

Referring to FIG. 3, several spools 10 are shown stacked on top of each other in a collapsed state. When spool 10 is collapsed, preferably the flange portion of panels 12 and 14 is large enough to enclose the folded arms. As such, the arms stay tucked within the collapsed spool and remain protected during transportation. As shown, once collapsed the space requirement of spools 10 is dramatically reduced making them easily handled, stored and transported.

Referring to FIG. 1 and FIGS. 4 through 10, construction of arms 16 and the manner in which they are connected to panels 12 and 14 will now be described in more detail. As shown in FIG. 1, each arm is connected at opposite ends to a corresponding support disk 18. In particular, at one end, arm 16 is connected to a support disk 18 by an inner hinge arrangement 30 and at an opposite end to an opposing disk 18 by an outer hinge arrangement 32. When spool 10 is collapsed, inner hinge 30 and outer hinge 32 fold conveniently together. In the embodiment illustrated in FIG. 1, besides each arm containing an inner hinge 30 and an outer hinge 32, hinges 30 and 32 alternate around the circumference of support disk 18.

Figure 4:
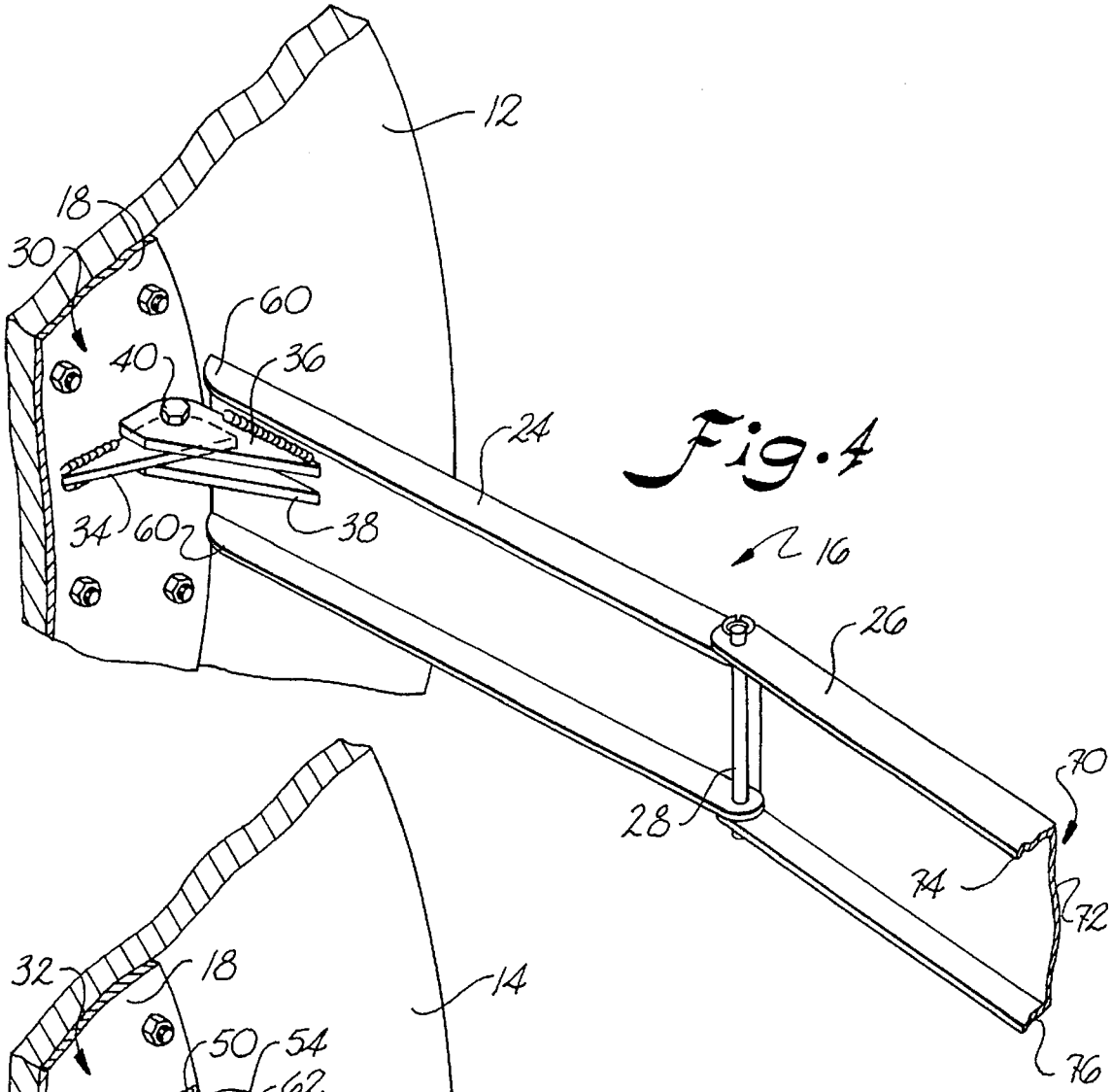
FIG. 4 is a perspective view with cut-away portions of one end of an arm used in a collapsible spool of the present invention.
Figure 5:
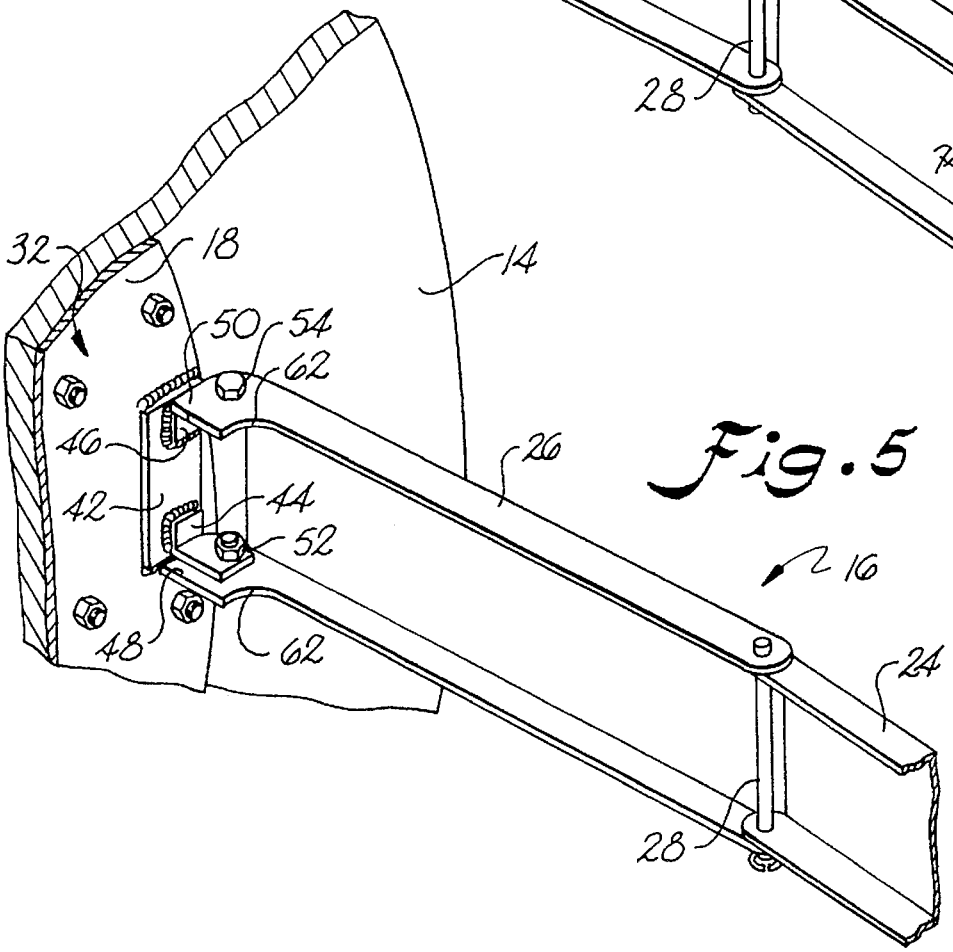
FIG. 5 is a perspective view with cut-away portions of the opposite end of the arm shown in FIG. 4.

Referring to FIGS. 4 and 5, a more detailed view of inner hinge 30 and outer hinge 32 are shown. As illustrated in FIG. 4, segment 24 of arm 16 is connected to support disk 18 by inner hinge 30. Inner hinge 30 includes a vertical hinge member 34 attached or welded to support disk 18. Hinge member 34 is pivotally connected to a pair of hinge plates 36 and 38 by a hinge screw 40. Hinge plates 36 and 38 are attached or welded to the end of segment 24 of arm 16 in a generally central or middle position. Inner hinge 30 is designed to allow segment 24 of arm 16 to move radially outward from support disk 18 but is also designed to prevent segment 24 from moving radially inward past a substantially horizontal and open position. As used herein, a horizontal position refers to a position when spool 10 is open and arms 16 are substantially perpendicular to panels 12 and 14.

Referring to FIG. 5, outer hinge 32 is shown connecting segment 26 of arm 16 to support disk 18. Outer hinge 32 includes an optional hinge floor 42 mounted to disk 18. A pair of L-shaped members 44 and 46 are attached to hinge floor 42 at opposing sides. L-shaped members 44 and 46 are also pivotally connected to a pair of outer hinge plates or tab portions 48 and 50 of segment 26. Specifically, a pair of pivot screws 52 and 54 are provided in order to rotatably connect segment 26 to L-shaped members 44 and 46. As shown, a pair of opposing pivot screws 52 and 54 are provided as opposed to constructing the hinge with a pivot pin similar to pin 28. By not using a pin, it is possible for inner hinge 30 to fold into outer hinge 32 as will be described hereinafter.

Similar to inner hinge 30, outer hinge 32 only permits segment 26 of arm 16 to rotate from a substantially horizontal position radially outward from disk 18 to a substantially vertical position. In other words, hinge 32 is designed to prevent segment 26 from moving radially inward past the horizontal position illustrated in FIG. 5.

Figure 9:
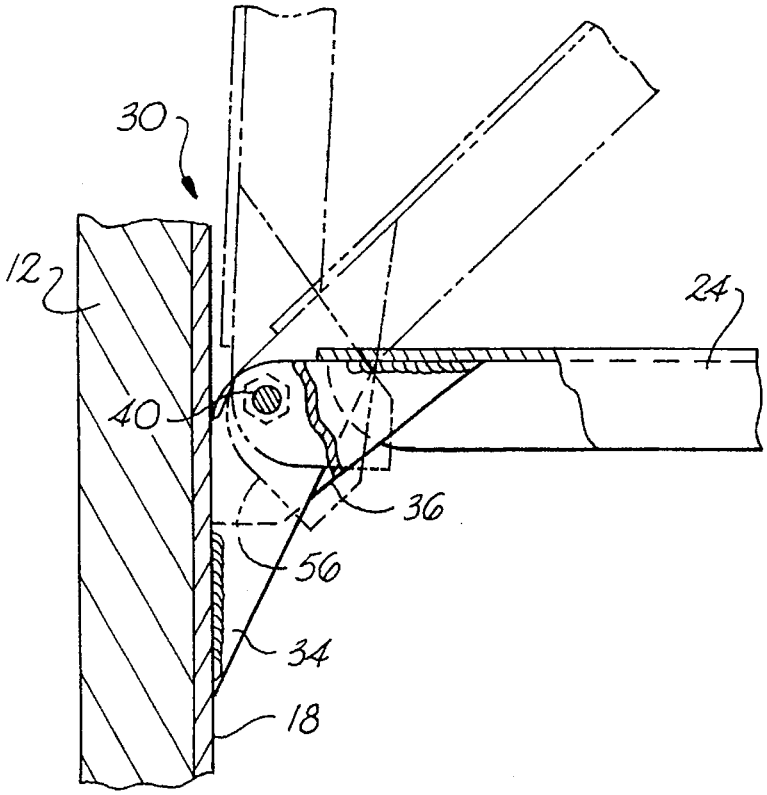
FIG. 9 is a side view of one end of the arm illustrated in FIG. 6.
Figure 10:
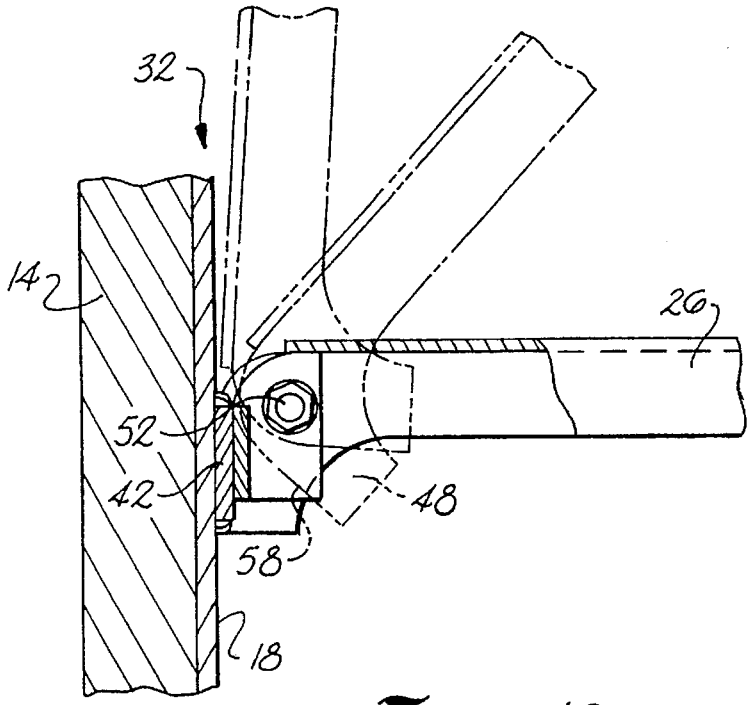
FIG. 10 is a side view of the opposite end of the arm shown in FIG. 9.

Referring FIGS. 9 and 10, the possible rotational positions of segments 24 and 26 are illustrated. As shown in FIG. 9, segment 24 of arm 16 can be placed in a substantially horizontal position indicating that the collapsible spool is open. Segment 24 can also be put in a substantially vertical position corresponding to when the spool is collapsed. However, inner hinge 30 prevents segment 24 from rotating radially inward. Specifically, hinge plate 36 and hinge plate 38 (not shown) include an edge 56 which acts like an abutment structure. When segment 24 is in a substantially horizontal position, edge 56 abuts against support disk 18 thereby preventing further rotation inward. As described above, support disk 18 must be made from a substantially hard material in order to provide support to edge 56.

When supporting a cable product, it is important to the spool of the present invention that the segments of the arms are not capable of rotating radially inward. It is also important for the arms to be capable of supporting heavy loads without collapsing inward. As such, the length of edge 56 can be varied in order to provide additional leverage strength if needed.

Referring to FIG. 10, outer hinge 32 is shown which includes a similar mechanism as that employed in inner hinge 30 to prevent segment 26 from rotating radially inward. Specifically, segment 26 includes hinge plate 48 and hinge plate 50 (not shown). Plates or abutment structures 48 and 50 include an edge 58 which abuts against either support disk 18 or hinge floor 42 when segment 26 is in substantially a horizontal position. Edge 58 prevents segment 26 from rotating radially inward and therefore prevents arm 16 from collapsing inward when a load is being supported.

Figure 6:
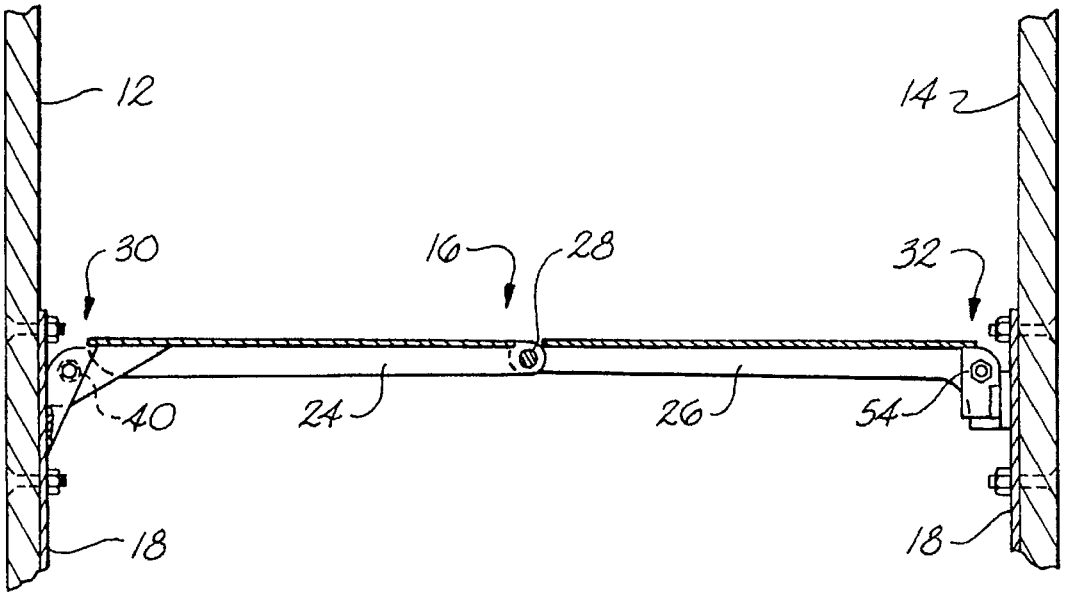
FIG. 6 is a side view of the arm illustrated in FIGS. 4 and 5.

Besides the particular design of hinges 30 and 32, the collapsible spool of the present invention also includes other features which assist in collapsing the spool and preventing the arms from collapsing inward when a cable product is wound thereon. For instance, as shown in FIG. 6, the pivot point 28 between segments 24 and 26 is slightly higher than the pivot points of hinges 30 and 32. In particular, in one embodiment, pivot pin 28 is positioned approximately 3/16 of an inch higher than pivot screw 40 and pivot screws 52 and 54 on arm 16. By positioning pivot pin 28 slightly higher than the pivoting points of hinges 30 and 32, arms 16 are more easily collapsed when the spool is emptied.

Further, in a preferred embodiment, the arms of the collapsible spool are not completely horizontal or straight when the spool is completely expanded. Instead, preferably segments 24 and 26 of arm 16 are at a slightly less than 180 degree angle when extended. In particular, the segments are preferably folded slightly outwards a few degrees when holding a cable product. This slight angle helps to prevent arm 16 from collapsing radially inward when supporting loads.

Figure 7:
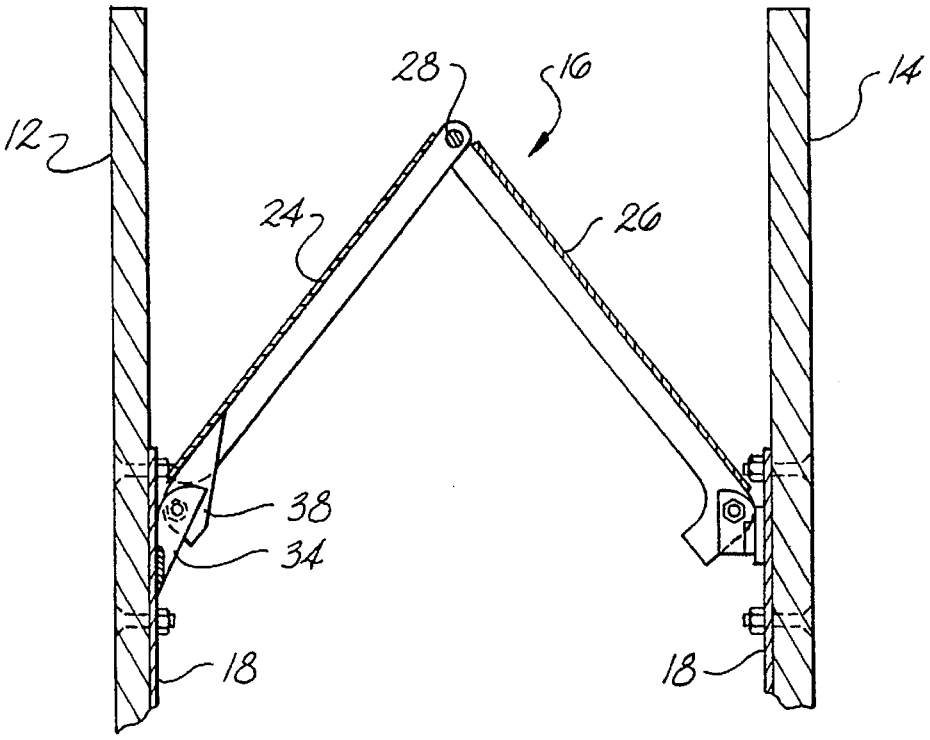
FIG. 7 is a side view of the arm illustrated in FIG. 6.
Figure 8:
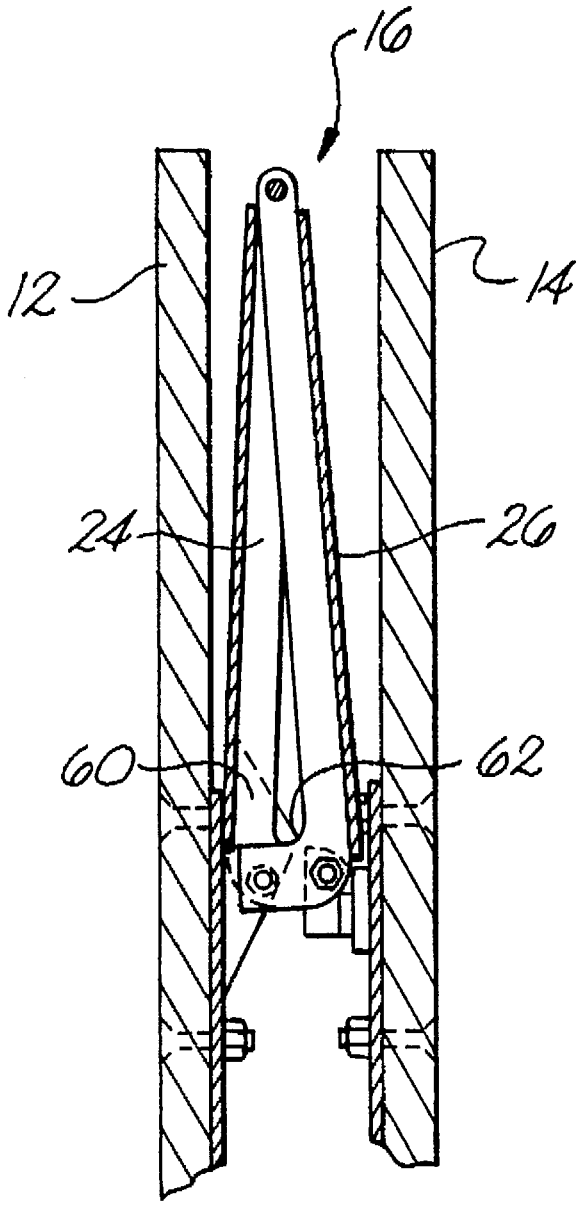
FIG. 8 is a side view of the arm illustrated in FIG. 6 in a folded position.

Referring to FIGS. 6, 7, and 8, a side view of arm 16 is shown going from an extended position to a collapsed and folded position. As shown in the figures, when the spool is collapsed arm 16 folds radially outward causing segments 24 and 26 to fold together. As more clearly shown in FIGS. 4 and 5, the end of segment 24 includes curved portions 60. Segment 26 of arm 16, on the other hand, includes curved indentations 62 which correspond to curved portions 60. As shown in FIG. 8, when arm 16 is folded, curved portion 60 rests inside of curved indentation 62 for allowing the ends of the segments to rest closely together.

Further, when arm 16 is folded, inner hinge 30 comes to rest in between pivot screws 52 and 54 of outer hinge 32. Depending upon the design, vertical hinge member 34 and hinge plates 36 and 38 can rest upon hinge floor 42. With this arrangement, segments 24 and 26 of arm 16 fold as close as possible together when the spool is collapsed. As such, when collapsed, the spool becomes easy to handle and transport.

Referring to FIG. 4, a cross-sectional view of arm 16 is generally illustrated at 70. As shown, arm 16 includes a flat portion 72 and pair of flanges 74 and 76 which are bent inward. However, in other embodiments, the cross-sectional shape of arm 16 can be varied depending upon the particular application. For instance, in order to give the core of the spool a more circular shape, flat portion 72 can be curved to represent a portion of a circle or oval. If flat portion 72 remained a flat surface, holes including corresponding flanges could be punched into arm 16 at various locations in order to increase strength.

In an alternative embodiment, springs can be installed about pivot pin 28 on arm 16. Preferably, the spring would bias segments 24 and 26 to fold outward. If installed on at least a number of the arms, the springs would make it easier for a user to collapse a spool. Preferably, the springs would also include a set position for when the spool is fully extended. In the set position, the spring would not exert a force on the segments of the arms and therefore would not cause the spool to collapse during use.

The number of arms to be installed on a spool of the present invention will depend upon a number of factors. Such factors include the cable product to be held and wound, the desired size of the core, or the cost of manufacturing the spool. In generally, the number of arms included in the spool can be anywhere from three to about twenty. In one embodiment, 14 arms can be used to create a 46 inch diameter core. In this embodiment, the arms can be about ¼ of an inch apart. This particular spool would be similar in size to many conventional spools.

Figure 11:
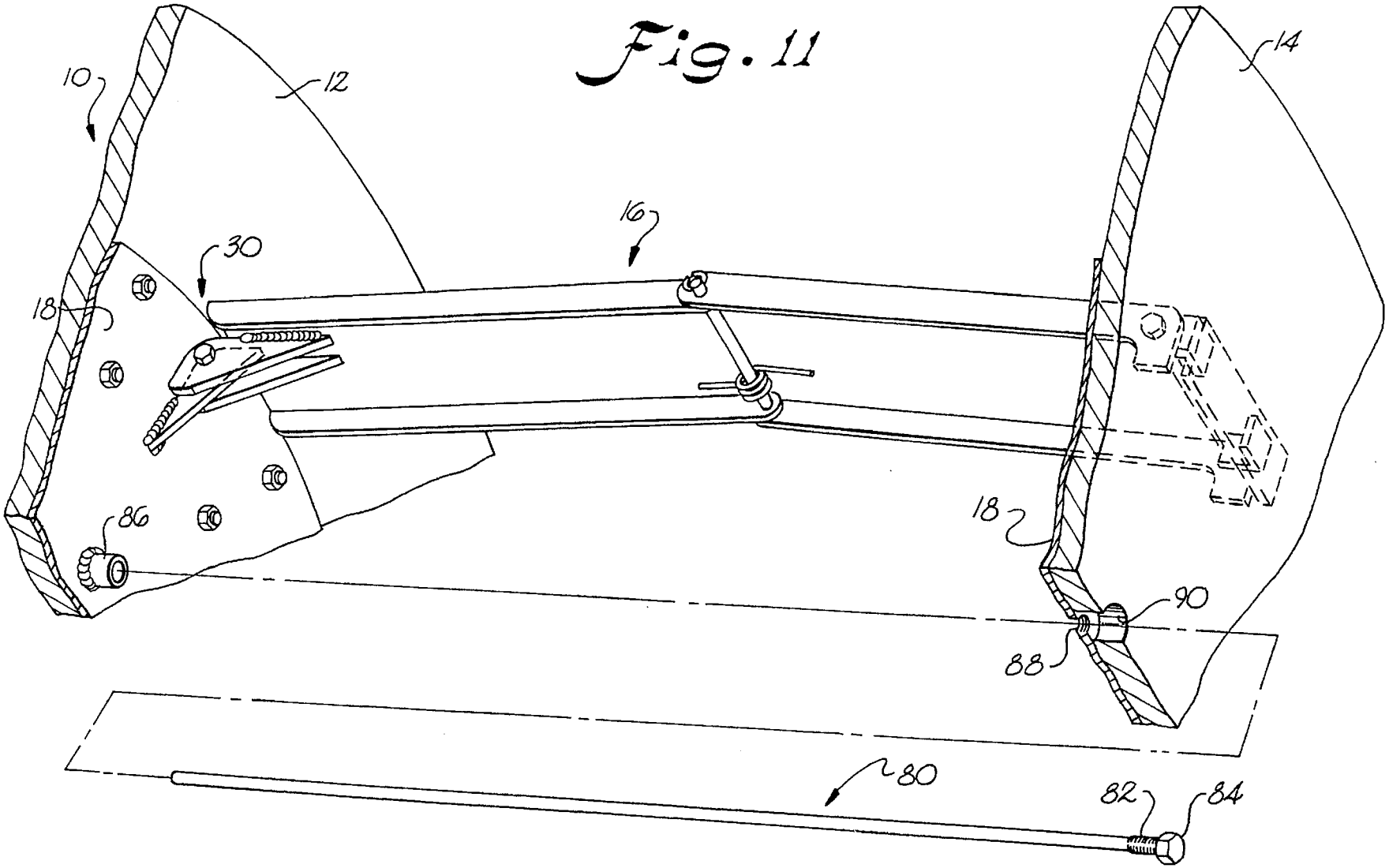
FIG. 11 is a perspective view with cut-away portions of an optional support rod for use in the present invention.

Referring to FIG. 11, another alternative feature that can be added to the collapsible spool of the present invention is illustrated. In this embodiment, a rod generally 80 is shown which can be used to bolster the strength of an expanded spool. As shown, rod 80 includes a threaded portion 82 having a diameter larger than the rest of the rod. Attached to threaded portion 82 is a nut head 84. As shown, side panel 12 of spool 10 includes a finger nipple 86 which can be mounted to support disk 18. On side panel 14 directly opposite nipple 86 is a passageway including a threaded portion 88 and an enlarged portion 90.

In this embodiment, rod 80 can be inserted into the passageway defined by panel 14. The end of the rod is adapted to fit within nipple 86. When spool 10 is expanded, threaded portion 82 can be screwed into the corresponding threaded passageway 88. Enlarged portion 90 is used to house nut head 84 so that it is not protruding from panel 14.

Once installed, rod 80 will bolster the strength of the expanded spool. In particular, by installing rod 80, arm 16 will be less likely to fold outward or inward.

Preferably, rod 80 will be installed a predetermined distance below arm 16. The number of rods that can be installed on a particular spool will vary depending upon the load. In most circumstances, no more than 5 rods will be needed. The rods can be spaced equal distances from each other in a circular arrangement below the arms. However, rods 80 are not necessary in the spool of the present invention and would only be installed in exceptional circumstances.

These and other modifications and variations to the present invention may be practiced by those of ordinary skill in the art, without departing from the spirit and scope of the present invention, which is more particularly set forth in the appended claims. In addition it should be understood that aspects of the various embodiments may be interchanged both in whole or in part. Furthermore, those of ordinary skill in the art will appreciate that the foregoing description is by way of example only, and is not intended to be limitative of the invention so further described in such appended claims.

What is claimed is:

1. A collapsible spool comprising:

a pair of opposing side panels, each of said panels including a circular center portion and a flange portion;

a plurality of foldable arms extending between and interconnecting said opposing side panels, each of said arms being hingedly connected to said opposing side panels at opposite ends, said arms being spaced circumferentially around said respective center portions of said opposing side panels, wherein each of said foldable arms includes a first segment and a second segment, said segments being pivotally joined at adjacent ends; and an inner hinge for connecting one end of each of said arms to one of said side panels and an outer hinge for connecting an opposite end of each of said arms to the other of said side panels, said inner hinge comprising a hinge member pivotally connecting said end of said arm to said respective side panel, said outer hinge comprising a first hinge plate spaced apart from a second hinge plate, said first hinge plate and said second hinge plate pivotally connecting said opposite end of said arm to the other of said side panels, said first and second hinge plates being spaced apart a distance sufficient to allow said hinge member of said inner hinge to come to rest in between said hinge plates when said arm is folded.

2. The collapsible spool as defined in claim 1, wherein each of said side panels further includes a support disk mounted to the circular center portion of each panel, said hinge member of said inner hinge of each of said arms being attached to one of said support disks mounted to one of said side panels while said hinge plates of said outer hinge of each of said arms being attached to the other of said support disks mounted to the other of said side panels.

3. The collapsible spool as defined in claim 1, wherein said inner hinge further includes at least one inner hinge plate attached to said end of said arm and pivotally connected to said hinge member.

4. The collapsible spool as defined in claim 1, wherein said spool comprises from about 3 to about 20 foldable arms.

5. The collapsible spool as defined in claim 1, wherein said first segment and said second segment of each of said arms are pivotally joined by a pivot pin.

6. The collapsible spool as defined in claim 5, wherein said inner hinge includes a first pivot point and said outer hinge includes a second pivot point and wherein said pivot pin used for joining said segments of each arm is spaced radially outward from said first pivot point and said second pivot point relative to an axis along which said opposing side panels are spaced.

7. The collapsible spool as defined in claim 1, wherein each of said arms further includes a first abutment structure at said one end and a second abutment structure at said opposite end of said arm, wherein, when said spool is placed in an open and uncollapsed position, said first abutment structure contacts one of said opposing side panels while said second abutment structure contacts the other of said side panels.

8. The collapsible spool as defined in claim 7, wherein said pair of opposing side panels are spaced along a longitudinal axis and wherein when said spool is placed in said open position, said first abutment structure and said second abutment structure of each arm are configured to contact each of said respective side panels in a manner so that said segments of each of said arms remain angled a few degrees radially outward relative to said longitudinal axis.

9. The collapsible spool as defined in claim 1, wherein each of said foldable arms further includes a spring positioned between said first segment and said second segment and biased to facilitate opening said spool.

10. A collapsible spool defining an open position adapted to receive a cable product and a closed and collapsed position, said collapsible spool comprising;

a pair of opposing circular side panels, said side panels being spaced along a longitudinal axis;

a plurality of foldable arms extending between and interconnecting said opposing side panels, each of said foldable arms being hingedly connected to said opposing side panels at opposite ends, each of said foldable arms further including a first segment and a second segment, said segments being pivotally joined at adjacent ends;

an inner hinge for connecting a first end of each of said arms to one of said side panels, said inner hinge comprising a hinge member pivotally connecting said end of said arm to said respective side panel at a substantially central position on said end of said arm; and an outer hinge for pivotally connecting a second and opposite end of each of said arms to the other of said side panels, said outer hinge comprising a first hinge connection to said opposite end spaced apart from a second hinge connection to said opposite end, said first and second hinge connections being spaced apart a distance sufficient to allow said hinge member of said inner hinge to come to rest in between said hinge connections when said arm is folded.

11. The collapsible spool as defined in claim 10, wherein said arms are made from a lightweight structural metal.

12. The collapsible spool as defined in claim 10, wherein each of said side panels further includes a support disk mounted thereto, said inner hinge being attached to said support disk mounted to one of said side panels while said outer hinge being attached to said support disk mounted to the other of said side panels.

13. The collapsible spool as defined in claim 10, wherein said segments of each arm are joined at a first pivot point, said inner hinge connects said first end of said arm to said side panel about a second pivot point, and said outer hinge connects said second end of said arm to the other of said side panels about a third pivot point and wherein said first pivot point joining said segments is spaced radially outward from said second pivot point and said third pivot point relative to said longitudinal axis.

14. The collapsible spool as defined in claim 10, wherein each of said arms further includes a first abutment structure at said first end and a second abutment structure at said second end of said arm, wherein, when said spool is placed in said open position, said first abutment structure contacts one of said opposing side panels while said second abutment structure contacts the other of said side panels.

15. The collapsible spool as defined in claim 14, wherein, when said spool is placed in said open position, said first abutment structure and said second abutment structure of each arm are configured to contact each of said respective side panels in a manner so that said segments of each of said arms remain angled a few degrees radially outward relative to said longitudinal axis.

16. The collapsible spool as defined in claim 10, wherein each of said foldable arms further includes a spring positioned between said first segment and said second segment and biased to facilitate opening said spool.

17. The collapsible spool as defined in claim 10, wherein said first end of each of said arms abuts against one of said side panels while said second end of each of said arms abuts against the other of said side panels when said spool is placed in said open position.

18. A collapsible spool defining an open position adapted to receive a cable product and a collapsed and closed position, said collapsible spool comprising:

a pair of opposing circular side panels, said side panels being spaced along a longitudinal axis;

a plurality of foldable arms extending between and interconnecting said opposing side panels, each of said arms being hingedly connected to said opposing side panels at opposite ends, wherein each of said foldable arms includes a first segment and a second segment, said segments being pivotally joined at adjacent ends for allowing each of said arms to fold radially outward relative to said longitudinal axis;

an inner hinge for connecting a first end of each of said arms to one of said side panels, said inner hinge including a hinge member attached to said side panel and pivotally connected to at least one inner hinge plate centrally mounted to said first end of said arm;

an outer hinge for connecting a second and opposite end of each of said arms to the other of said side panels, said outer hinge including a pair of spaced apart outer hinge plates pivotally connecting said second end of said arm to said side panel, said outer hinge plates being spaced apart a distance sufficient to allow said hinge member and said at least one inner hinge plate of said inner hinge to come to rest in between said outer hinge plates when said arm is folded; and a first abutment structure at said first end of each of said arms and a second abutment structure at said second end of each of said arms, wherein, when said spool is placed in said open position, said first abutment structure contacts one of said opposing side panels while said second abutment structure contacts the other of said side panels.

* * * * *